US011572998B2

(12) United States Patent
Matsumoto

(10) Patent No.: US 11,572,998 B2
(45) Date of Patent: Feb. 7, 2023

(54) VEHICLE LAMP

(71) Applicant: KOITO MANUFACTURING CO., LTD., Tokyo (JP)

(72) Inventor: Akinori Matsumoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/440,680

(22) PCT Filed: Mar. 26, 2020

(86) PCT No.: PCT/JP2020/013654
§ 371 (c)(1),
(2) Date: Sep. 17, 2021

(87) PCT Pub. No.: WO2020/203641
PCT Pub. Date: Oct. 8, 2020

(65) Prior Publication Data

US 2022/0178511 A1 Jun. 9, 2022

(30) Foreign Application Priority Data

Apr. 1, 2019 (JP) ..... JP2019-069812

(51) Int. Cl.
*F21S 41/32* (2018.01)
*F21S 41/25* (2018.01)
(Continued)

(52) U.S. Cl.
CPC ..... *F21S 41/322* (2018.01); *F21S 41/143* (2018.01); *F21S 41/25* (2018.01); *F21Y 2115/10* (2016.08)

(58) Field of Classification Search
None
See application file for complete search history.

(56) References Cited

U.S. PATENT DOCUMENTS 7,270,454 B2 * 9/2007 Amano ..... F21V 5/04 362/330
8,591,083 B2 * 11/2013 Koizumi ..... F21V 5/04 362/520
(Continued)

FOREIGN PATENT DOCUMENTS

EP 2211087 A2 * 7/2010 ..... F21S 48/215
JP 2004-327095 A 11/2004
(Continued)

OTHER PUBLICATIONS

International Search Report dated May 26, 2020 for WO 2020/203641 A1 (5 pages).

*Primary Examiner* — Elmito Breval
(74) *Attorney, Agent, or Firm* — Venjuris, P.C.

(57) ABSTRACT

A vehicle lamp includes a lamp unit which in turn includes a first lamp unit and a second lamp unit each provided with a light transmitting member and is configured to irradiate light emitted from a light emitting element toward a front of the vehicle lamp through the light transmitting member. In each of the first and second lamp units, the light transmitting member includes a direct light controller that directly emits light incident from the light emitting element onto the light transmitting member, toward the front of the vehicle lamp, and a total reflection controller that totally reflects the light and then emits the light toward the front of the vehicle lamp. A total reflection surface of the total reflection controller is divided into a plurality of reflection regions in a circumferential direction around the direct light controller.

7 Claims, 13 Drawing Sheets

(51) Int. Cl.
*F21S 41/143* (2018.01)
*F21Y 115/10* (2016.01)

(56) References Cited

U.S. PATENT DOCUMENTS

| | | | | |
|---|---|---|---|---|
| 2008/0310028 | A1* | 12/2008 | Chinniah | F21V 7/0091 359/642 |
| 2010/0259153 | A1* | 10/2010 | Futami | F21S 43/247 313/114 |
| 2015/0078029 | A1* | 3/2015 | Kumar | F21S 41/336 362/522 |
| 2016/0312972 | A1* | 10/2016 | Izawa | F21S 43/14 |

FOREIGN PATENT DOCUMENTS

| | | | |
|---|---|---|---|
| JP | 2005-108555 | A | 4/2005 |
| JP | 2005-203111 | A | 7/2005 |
| JP | 2009-146665 | A | 7/2009 |
| JP | 2009-283299 | A | 12/2009 |
| JP | 2015-049976 | A | 3/2015 |

* cited by examiner

VEHICLE LAMP

CROSS REFERENCE TO RELATED APPLICATIONS

This application is a national phase of PCT application No. PCT/JP2020/013654, filed on 26 Mar. 2020, which claims priority from Japanese patent application No. 2019-069812, filed on 1 Apr. 2019, all of which are incorporated herein by reference.

TECHNICAL FIELD

The present disclosure relates to a vehicle lamp including a lamp unit configured to irradiate light emitted from a light emitting element toward the front of a lamp through a light transmitting member.

BACKGROUND

In the related art, as a configuration of a vehicle lamp, a vehicle lamp including a lamp unit configured to irradiate light emitted from a light emitting element toward the front of a lamp through a light transmitting member has been known.

Patent Document 1 discloses a configuration of a light transmitting member of a lamp unit of a vehicle lamp including a direct light controller that directly emits light incident from a light emitting element onto the light transmitting member toward the front of a lamp, and a total reflection controller that totally reflects the light incident from the light emitting element onto the light transmitting member, and then emits the light toward the front of the lamp.

Further, Patent Document 2 discloses a configuration of a light transmitting member in which the total reflection surface of the total reflection controller is divided into a plurality of reflection regions in a circumferential direction around the direct light controller.

PRIOR ART DOCUMENT

Patent Document

Patent Document 1: Japanese Laid-Open Patent Publication No. 2009-146665

Patent Document 2: Japanese Laid-Open Patent Publication No. 2009-283299

SUMMARY OF THE INVENTION

Problem to be Solved

Like the lamp unit disclosed in Patent Document 1, by adopting a configuration including the direct light controller and the total reflection controller as the light transmitting member, it is possible to emit most of the light emitted from the light emitting element from the light transmitting member toward the front of the lamp, and thus, it is possible to improve the utilization efficiency of the light source light flux.

At this time, by adopting the light transmitting member as disclosed in Patent Document 2, it is possible to align the upper end positions of the light distribution patterns formed by reflected light from each reflection region that constitutes the total reflection surface of the total reflection controller and thus, it is possible to form a light distribution pattern having a cut-off line at the upper end edge as a light distribution pattern formed by light emitted from the total reflection controller.

However, even in the case where such configuration is adopted, it is not easy to form a bright light distribution pattern having horizontal and oblique cut-off lines at the upper end edge.

The present disclosure has been made in consideration of the circumstances, and in a vehicle lamp including a lamp unit configured to irradiate light emitted from a light emitting element toward the front of the lamp through a light transmitting member, is to provide a vehicle lamp capable of forming a bright light distribution pattern having horizontal and oblique cut-off lines at the upper end edge after improving the utilization efficiency of light source light flux.

Means to Solve the Problem

The present disclosure is to provide a configuration including predetermined first and second lamp units.

That is, in a vehicle lamp according to the present disclosure including a lamp unit configured to irradiate light emitted from a light emitting element toward a front of a lamp through a light transmitting member, and including a first lamp unit and a second lamp unit. In each of the first and second lamp units, the light transmitting member includes a direct light controller that directly emits light incident from the light emitting element onto the light transmitting member, toward the front of the lamp, and a total reflection controller that totally reflects the light and then emits the light toward the front of the lamp. A total reflection surface of the total reflection controller is divided into a plurality of reflection regions in a circumferential direction around the direct light controller. A plurality of horizontal diffusion lens elements that diffuses the light emitted from the light transmitting member in a horizontal direction is formed on an emission surface of the light transmitting member of the first lamp unit. A plurality of oblique diffusion lens elements that diffuses the light emitted from the light transmitting member in an oblique direction inclined with respect to the horizontal direction is formed on an emission surface of the light transmitting member of the second lamp unit.

A type of the "light emitting element" is not particularly limited, and examples thereof may include a light emitting diode or a laser diode.

The specific shape of the "horizontal diffusion lens element" is not particularly limited as long as it is configured to diffuse light emitted from the light transmitting member in the horizontal direction.

The specific shape of the "oblique diffusion lens element" is not particularly limited as long as it is configured to diffuse light emitted from the light transmitting member in the oblique direction inclined with respect to the horizontal direction.

Effect of the Invention

The vehicle lamp according to the present disclosure includes the first and second lamp units, and the light transmitting member of each of the first and second lamp units includes the direct light controller that directly emits light incident from the light emitting element onto the light transmitting member toward the front of the lamp, and the total reflection controller that totally reflects the light incident from the light emitting element onto the light transmitting member, and then emits the light toward the front of the lamp. Therefore, it is possible to emit most of the light emitted from the light emitting element from the light transmitting member toward the front of the lamp, and thus, it is possible to improve the utilization efficiency of the light source light flux.

At this time, in each of the first and second lamp units, the total reflection surface of the total reflection controller in the light transmitting member is divided into a plurality of reflection regions in the circumferential direction around the direct light controller. Therefore, it is possible to easily align the upper end positions of the light distribution patterns formed by the reflected light from each reflection region.

A plurality of horizontal diffusion lens elements that diffuses the light emitted from the light transmitting member in the horizontal direction is formed on the emission surface of the light transmitting member of the first lamp unit, and a plurality of oblique diffusion lens elements that diffuses the light emitted from the light transmitting member in the oblique direction inclined with respect to the horizontal direction is formed on the emission surface of the light transmitting member of the second lamp unit. Therefore, it is possible to form a bright light distribution pattern having horizontal and oblique cut-off lines at the upper end edge by the irradiation light from the first and second lamp units.

As described above, according to the present disclosure, the vehicle lamp includes the lamp unit configured to irradiate the light emitted from the light emitting element toward the front of the lamp through the light transmitting member, and is capable of forming a bright light distribution pattern having horizontal and oblique cut-off lines at the upper end edge after improving the utilization efficiency of the light source light flux.

In the configuration, further, the light emitting element of the first lamp unit is disposed such that the lower end edge of the light emitting surface of the light emitting element extends in the horizontal direction, and the light emitting element of the second lamp unit is disposed such that the lower end edge of the light emitting surface of the light emitting element extends in the oblique direction. Therefore, the light distribution pattern formed by the light emitted from the direct light controller of the first lamp unit may be a light distribution pattern having a clear horizontal cut-off line at the upper end edge, and the light distribution pattern formed by the light emitted from the direct light controller of the second lamp unit may be a light distribution pattern having a clear oblique cut-off line at the upper end edge.

In the configuration, further, in the light transmitting member of the first lamp unit, a diffusion angle of a horizontal diffusion lens element formed on an emission surface of the direct light controller is set to be larger than a diffusion angle of the horizontal diffusion lens element formed on the emission surface of the total reflection controller, and in the light transmitting member of the second lamp unit, a diffusion angle of the oblique diffusion lens element formed on an emission surface of the direct light controller is set to be larger than a diffusion angle of the oblique diffusion lens element formed on an emission surface of the total reflection controller. As a result, following operation effects may be obtained.

That is, since the direct light controller is positioned closer to the light emitting element than the total reflection controller, the light distribution pattern formed by the light emitted from the direct light controller becomes a light distribution pattern larger than the light distribution pattern formed by the light emitted from the total reflection controller.

Therefore, the diffusion angles of the horizontal diffusion lens element and the oblique diffusion lens element formed on the emission surface of the direct light controller are set to values larger than those of the diffusion angles of the horizontal diffusion lens element and the oblique diffusion lens element formed on the emission surface of the total reflection controller, so that the light distribution pattern formed by the irradiation light from the first and second lamp units may be formed as light distribution patterns with less light distribution unevenness.

In the configuration, further, in the light transmitting member of the first lamp unit, the emission surface of the total reflection controller is divided into an inner peripheral side annular region and an outer peripheral side annular region, and then, a diffusion angle of the horizontal diffusion lens element formed on the inner peripheral side annular region is set to be larger than a diffusion angle of the horizontal diffusion lens element formed on the outer peripheral side annular region, and in the light transmitting member of the second lamp unit, the emission surface of the total reflection controller is divided into an inner peripheral side annular region and an outer peripheral side annular region, and then, a diffusion angle of the oblique diffusion lens element formed on the inner peripheral side annular region is set to a value larger than that of a diffusion angle of the oblique diffusion lens element formed on the outer peripheral side annular region. As a result, following operation effects may be obtained.

That is, the light distribution pattern formed by the light emitted from the inner peripheral side annular region becomes a light distribution pattern larger than the light distribution pattern formed by the light emitted from the outer peripheral side annular region.

Therefore, the diffusion angles of the horizontal diffusion lens element and the oblique diffusion lens element formed on the inner peripheral side annular region are set to values larger than those of the diffusion angles of the horizontal diffusion lens element and the oblique diffusion lens element formed on the outer peripheral side annular region, so that the light distribution pattern formed by the irradiation light from the first and second lamp units may be formed as light distribution patterns with less light distribution unevenness.

At this time, in each of the light transmitting members of the first and second lamp units, the emission surface of the total reflection controller is displaced forward of the lamp with respect to the emission surface of the direct light controller, and the outer peripheral side annular region of the emission surface of the total reflection controller is displaced forward of the lamp with respect to the inner peripheral side annular region of the emission surface. As a result, the thickness of the light transmitting member may be reduced.

In such a case, in the light transmitting member of the first lamp unit, the horizontal diffusion lens element formed on the emission surface of the direct light controller and the horizontal diffusion lens element formed on the inner peripheral side annular region of the emission surface of the total reflection controller are configured such that a diffusion angle in a direction approaching the light emitting element in a front view of the lamp is set to have a value larger than that of a diffusion angle in a direction away from the light emitting element, and in the light transmitting member of the second lamp unit, the oblique diffusion lens element formed on the emission surface of the direct light controller and the oblique diffusion lens element formed on the inner peripheral side annular region of the emission surface of the total reflection controller are configured such that a diffusion angle in a direction approaching the light emitting element in the front view of the lamp is set to have a value larger than that of a diffusion angle in a direction away from the light emitting element. As a result, following operation effects may be obtained.

That is, the light emitted from the emission surface of the direct light controller may be hardly blocked by a standing wall positioned on the outer peripheral side of the emission surface, and the light emitted from the inner peripheral side annular region of the emission surface of the total reflection controller may be hardly blocked by a standing wall positioned on the outer peripheral side of the emission surface. Therefore, it is possible to improve the utilization efficiency of the light source light flux and to effectively suppress the generation of stray light.

BRIEF DESCRIPTION OF THE DRAWINGS

FIG. 6A is a view illustrating a low beam light distribution pattern, and FIG. 6B is a view illustrating a high beam light distribution pattern.

Figure 10:
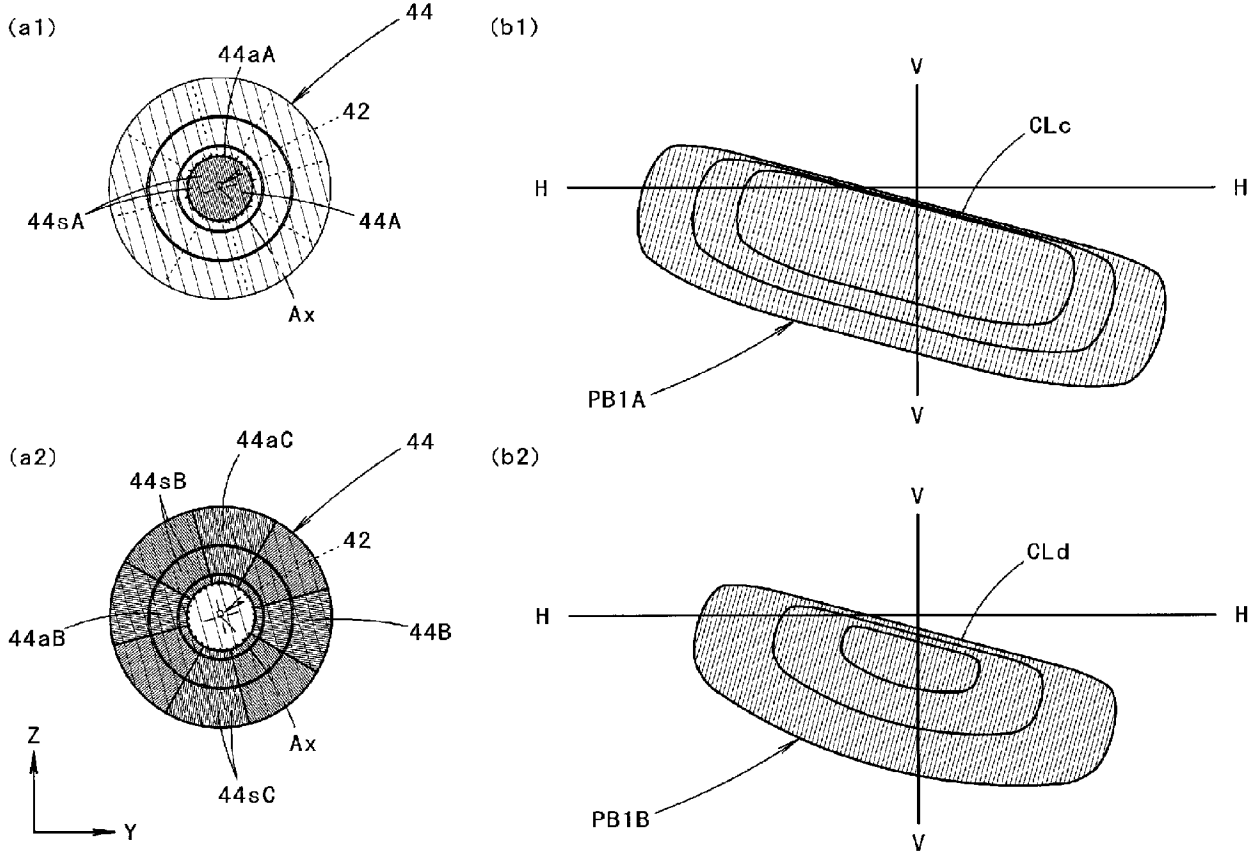

(a1) and (b1) of FIG. 10 are views illustrating a light distribution pattern formed by light emitted from a direct light controller of a second lamp unit of the vehicle lamp together with a configuration of the second lamp unit, and (a2) and (b2) of FIG. 10 are views illustrating a light distribution pattern formed by light emitted from a total reflection controller of the second lamp unit together with the configuration of the second lamp unit.

Figure 4:
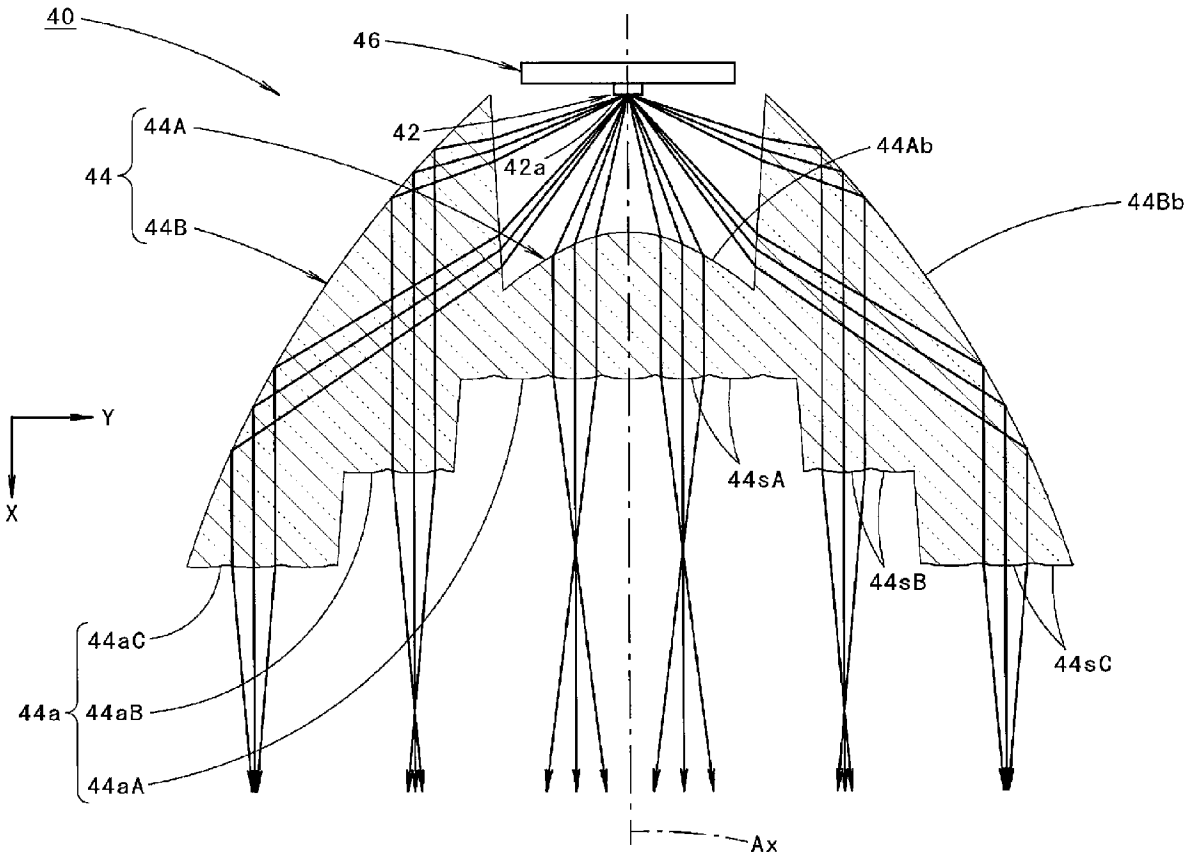
FIG. 4 is a cross-sectional view taken along line IV-IV of FIG. 1.
Figure 11:
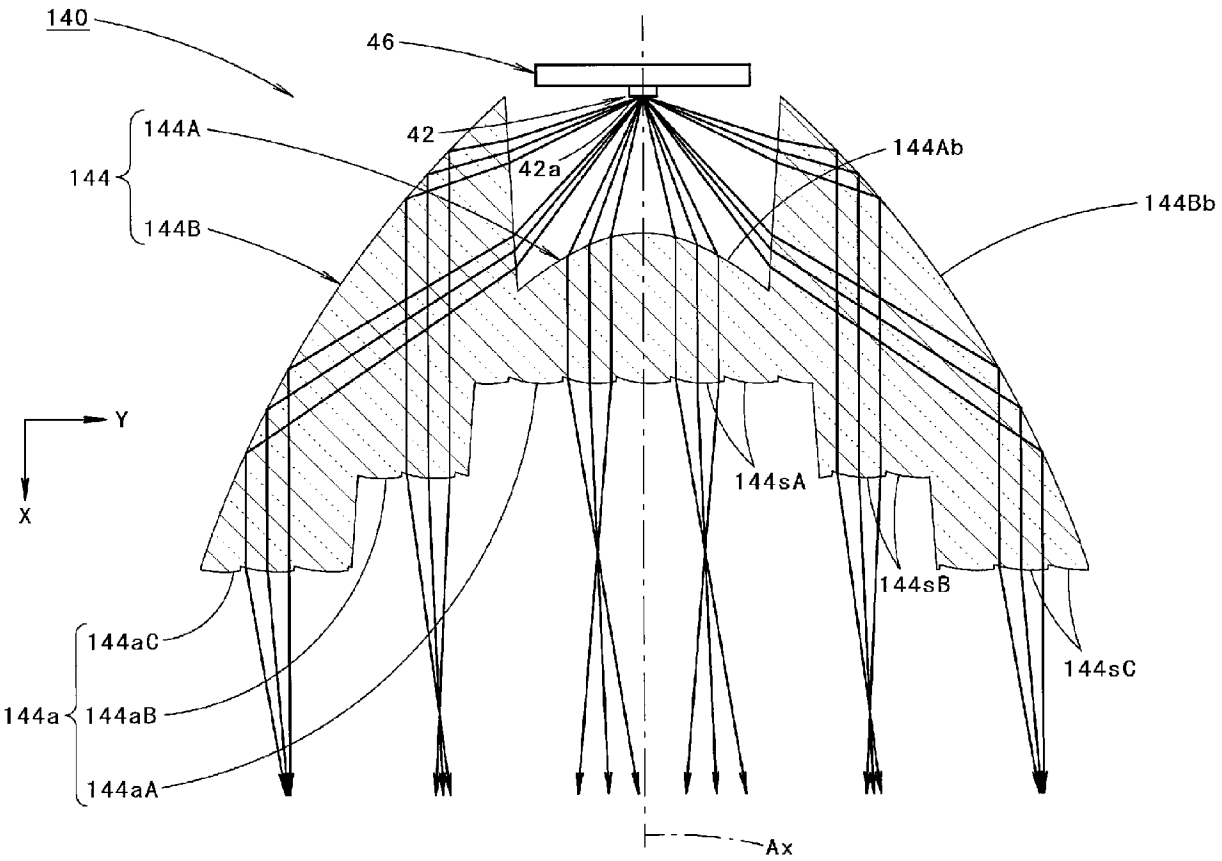

FIG. 11 is a view illustrating Modification 1 of the embodiment, which is similar to FIG. 4.

Figure 6A:
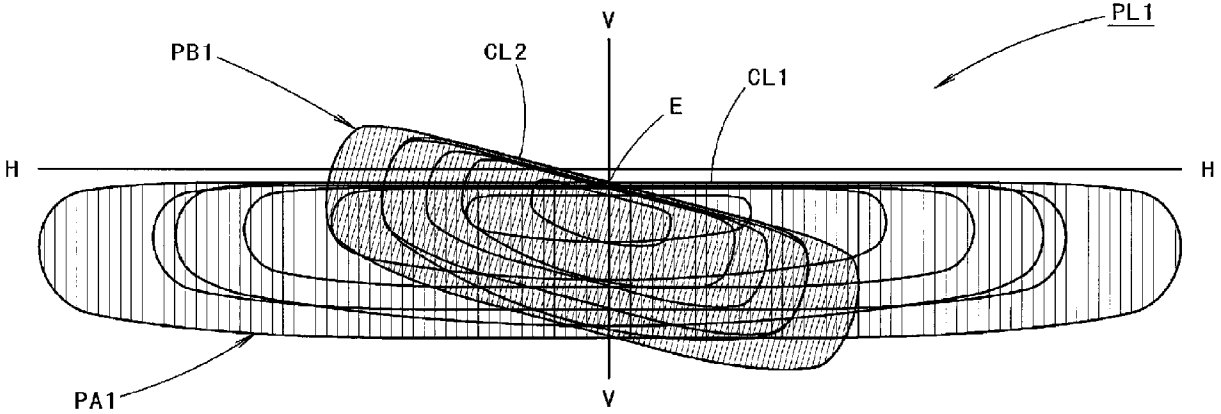
FIGS. 6A and 6B are views transparently illustrating a light distribution pattern formed by irradiation light from the vehicle lamp.
Figure 6B:
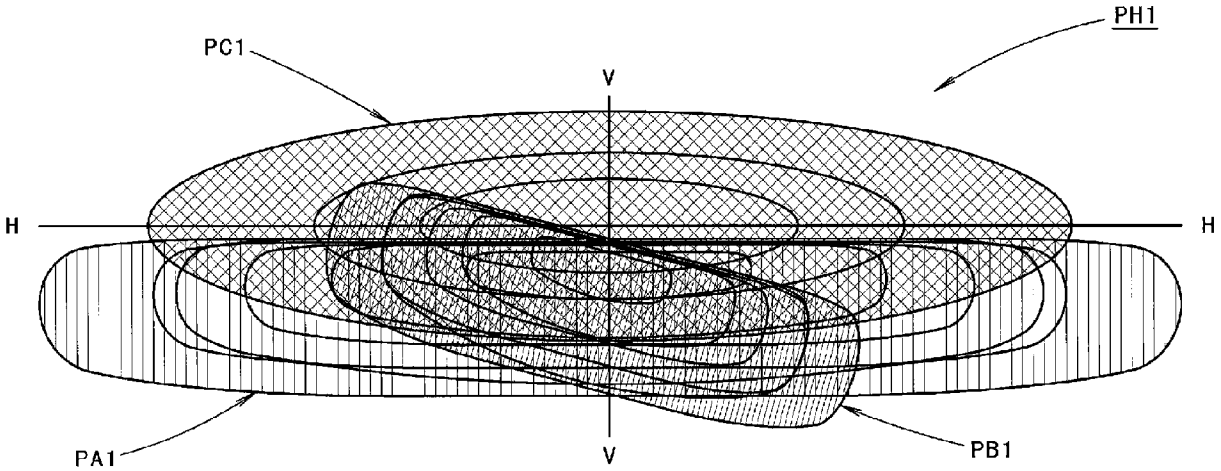
Figure 12A:
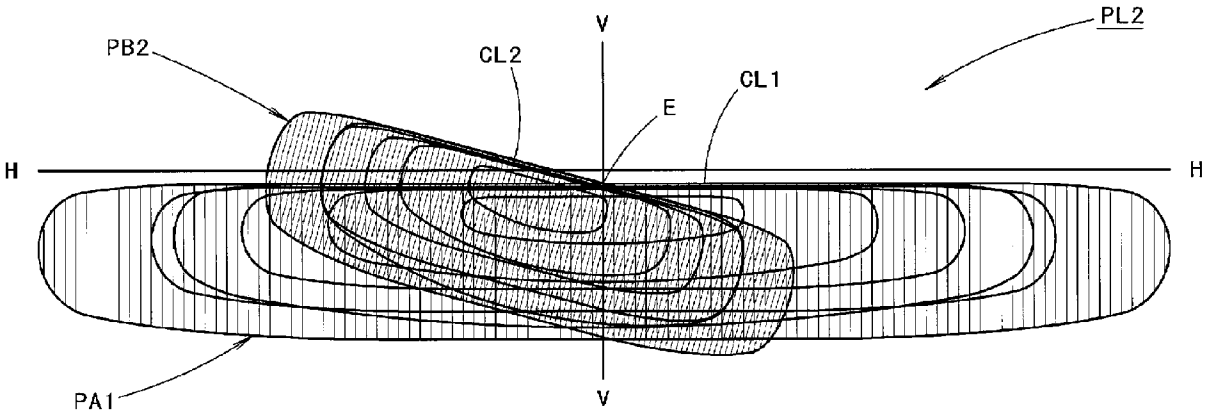
Figure 12B:
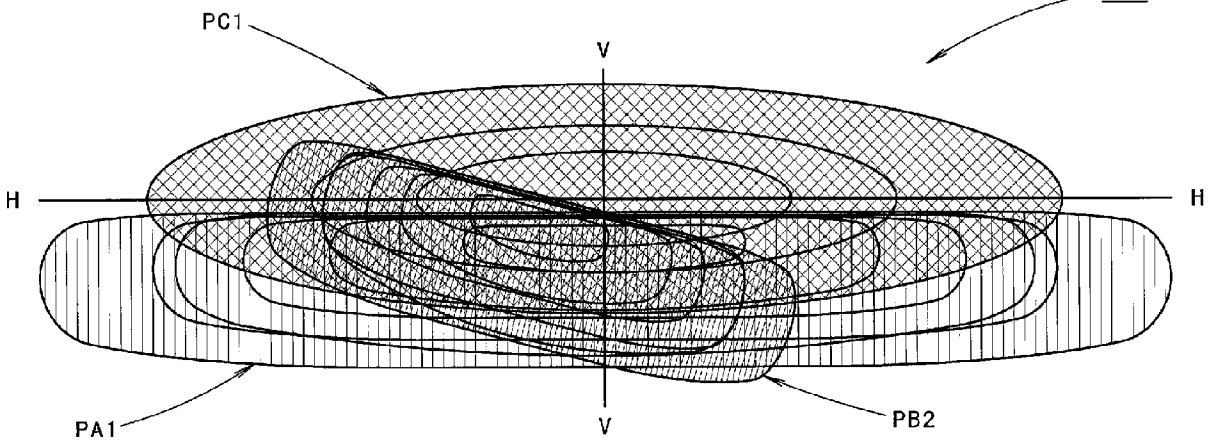

FIGS. 12A and 12B are views illustrating an operation of Modification 1, which are similar to FIGS. 6A and 6B.

Figure 3:
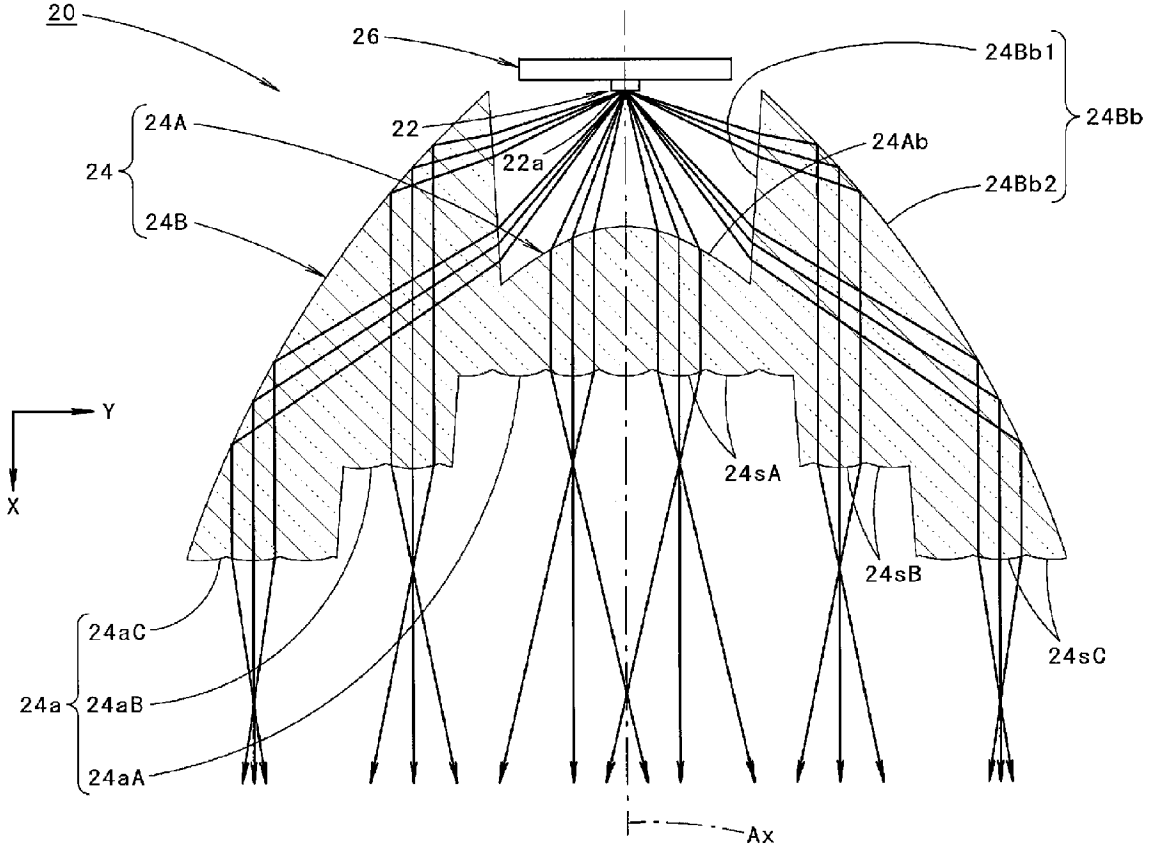
FIG. 3 is a cross-sectional view taken along line III-III of FIG. 1.
Figure 13:
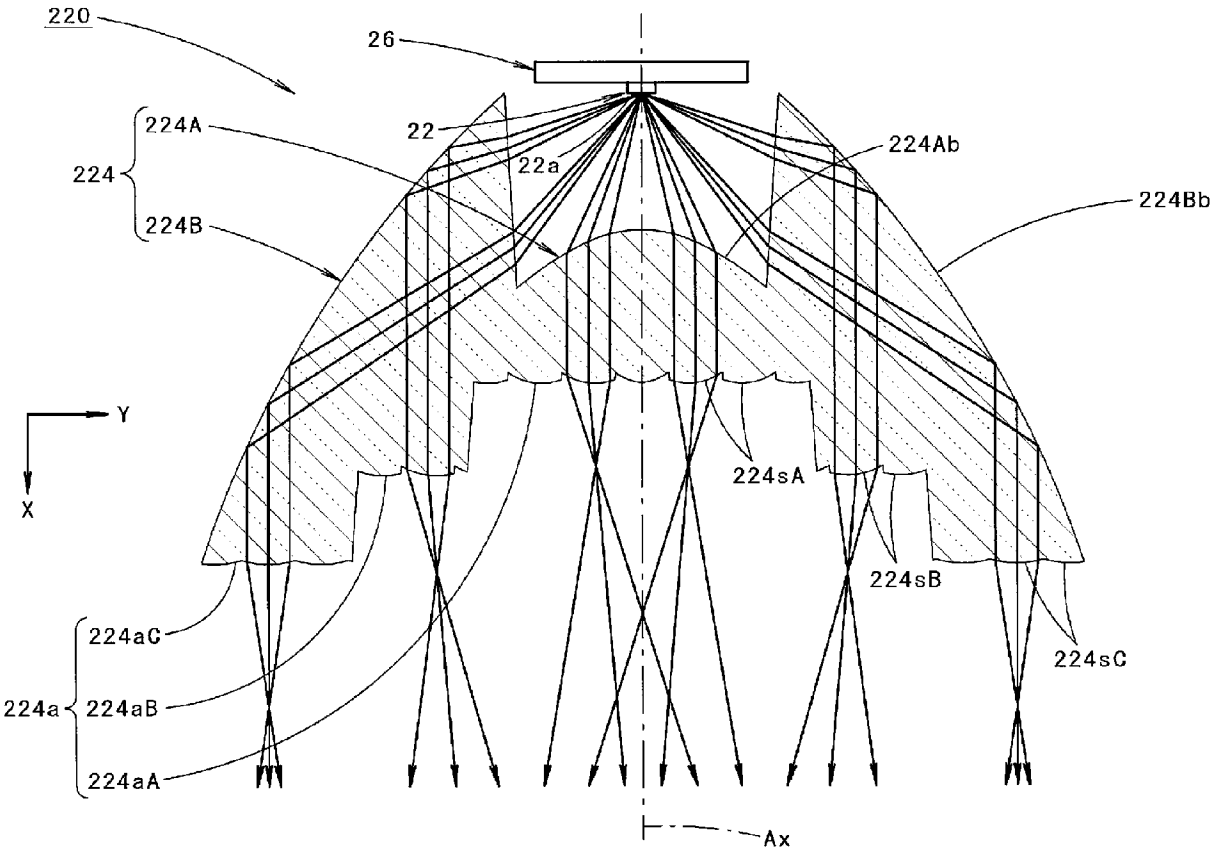

FIG. 13 is a view illustrating Modification 2 of the embodiment, which is similar to FIG. 3.

DETAILED DESCRIPTION TO EXECUTE THE INVENTION

Hereinafter, an embodiment of the present disclosure will be described with reference to drawings.

Figure 1:
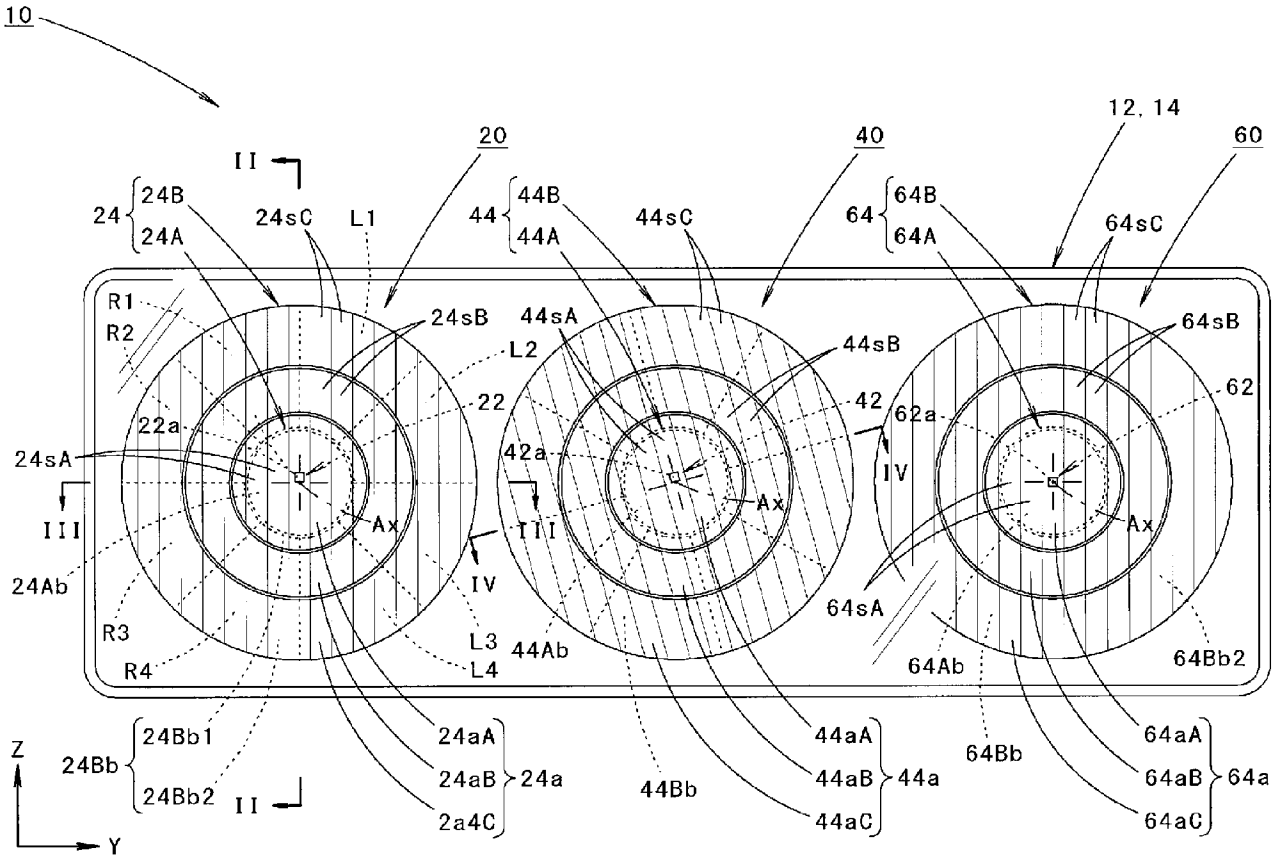
FIG. 1 is a front view of a vehicle lamp according to an embodiment of the present disclosure.
Figure 2:
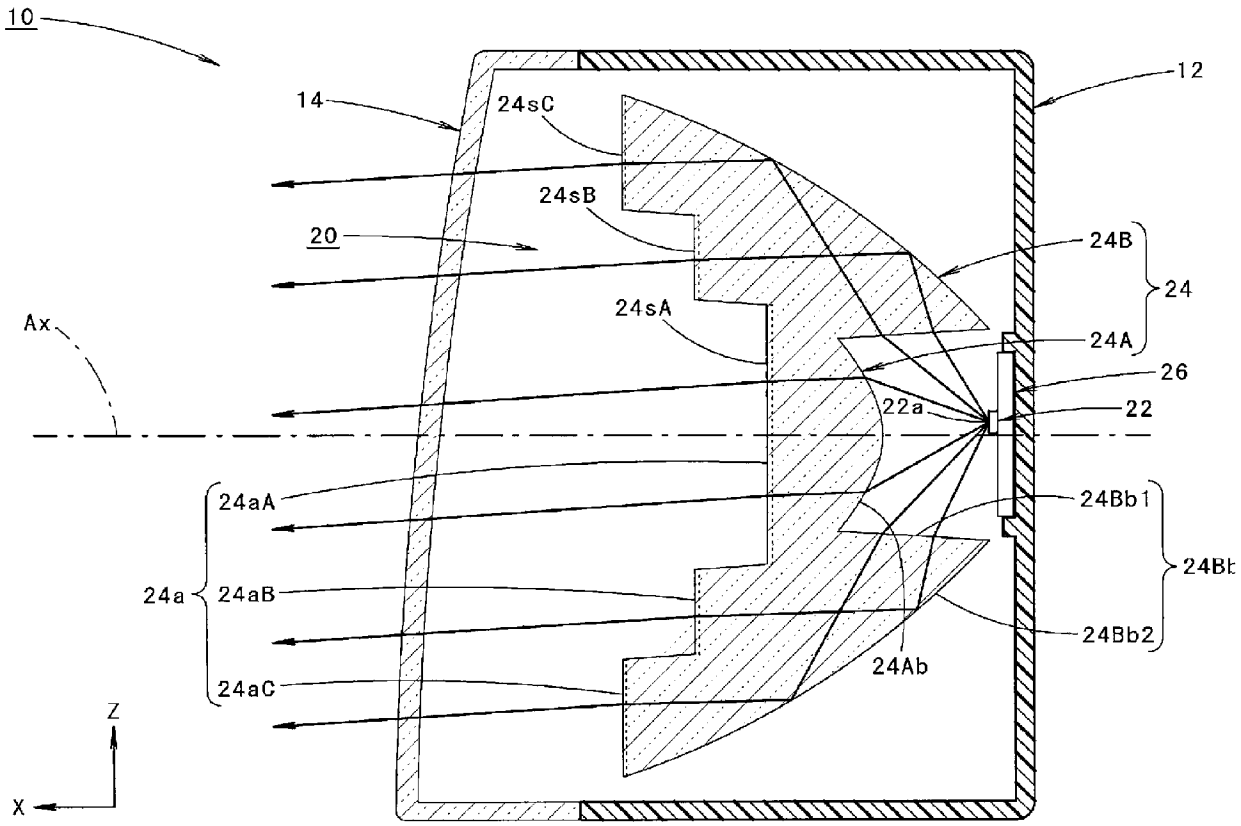
FIG. 2 is a cross-sectional view taken along line II-II of FIG. 1.

FIG. 1 is a front view of a vehicle lamp 10 according to an embodiment of the present disclosure. FIG. 2 is a cross-sectional view taken along line II-II of FIG. 1, FIG. 3 is a cross-sectional view taken along line III-III of FIG. 1, and FIG. 4 is a cross-sectional view taken along line IV-IV of FIG. 1.

In these drawings, the direction indicated by X is the "front" for a vehicle lamp 10 (also "front" for a vehicle), the direction indicated by Y is the "left direction" orthogonal to the "front" (also "left direction for a vehicle, but "right direction" in the front view of a lamp", and the direction indicated by Z is the "upper direction." This is also applied to other drawings.

As illustrated in FIG. 1, the vehicle lamp 10 according to the embodiment is a head lamp provided at the front end portion of a vehicle, and is configured such that projector type first, second, and third lamp units 20, 40, and 60 are incorporated in a lamp chamber formed by a lamp body 12 and a transparent light transmitting cover 14 attached to the front end opening of the lamp body 12.

Then, the vehicle lamp 10 is configured to form a low beam light distribution pattern by irradiation light from the first and second lamp units 20 and 40, and to form a high beam light distribution pattern by adding irradiation light of the third lamp unit 60.

First, a configuration of the first lamp unit 20 will be described.

Figure 5:
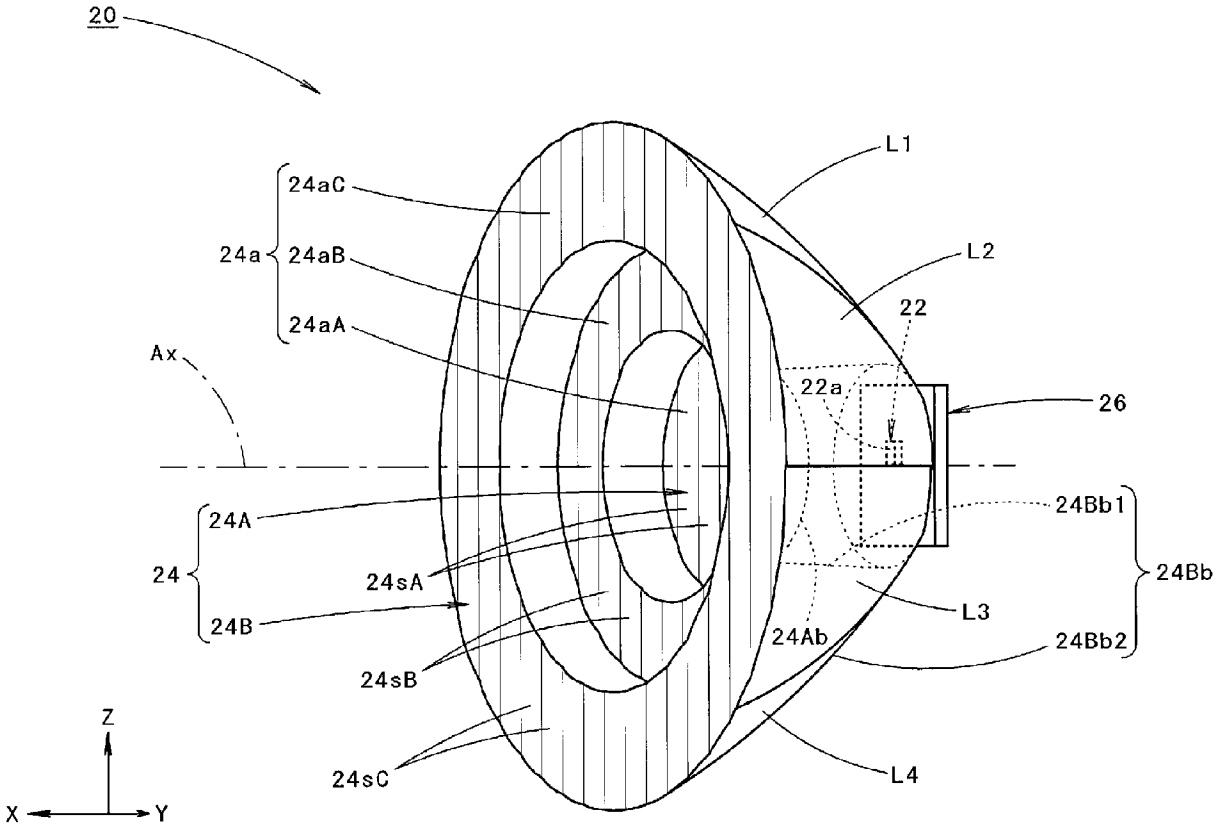
FIG. 5 is a perspective view illustrating a first lamp unit of the vehicle lamp as a single item.

FIG. 5 is a perspective view illustrating a first lamp unit 20 as a single item.

As illustrated in FIGS. 2, 3, and 5, the first lamp unit 20 is configured to irradiate light emitted from a light emitting element 22 toward the front of the lamp through a light transmitting member 24.

The light emitting element 22 is a white light emitting diode having a rectangular (e.g., square) light emitting surface 22*a*, and is disposed toward the front of the lamp (also the front for the vehicle) in a state of being mounted on a substrate 26. The substrate 26 is supported by the lamp body 12.

The light emitting element 22 is disposed in a state where the lower end edge of the light emitting surface 22*a* extends in the horizontal direction above near an axis Ax extending in the front-rear direction of the lamp.

The light transmitting member 24 is formed of a transparent synthetic resin molded article such as an acrylic resin. The light transmitting member 24 is disposed in front of the lamp of the light emitting element 22 and supported by the lamp body 12 via a support structure (not illustrated).

The light transmitting member 24 is configured to include a direct light controller 24A that directly emits light incident from the light emitting element 22 onto the light transmitting member 24 toward the front of the lamp, and a total reflection controller 24B that totally reflects the light incident from the light emitting element 22 onto the light transmitting member 24, and then emits the light toward the front of the lamp.

The direct light controller 24A is set as a circular region centered on the axis Ax in the front view of the lamp.

A rear surface 24Ab of the direct light controller 24A is configured as a rotational curved surface having a convex curved surface shape centered on the axis Ax. Then, the direct light controller 24A is configured to direct light emitted from the light emission center of the light emitting element 22 on the rear surface 24Ab as parallel light slightly downward to be incident.

The total reflection controller 24B is a region positioned on the outer peripheral side of the direct light controller 24A, and is set as an annular region centered on the axis Ax in the front view of the lamp.

A rear surface 24Bb of the total reflection controller 24B includes an incident surface 24Bb1 that refracts the light emitted from the light emitting element 22 in the direction away from the axis Ax to be incident, and a total reflection surface 24Bb2 that totally reflects the incident light from the incident surface 24Bb1 toward the front of the lamp.

The incident surface 24Bb1 is configured as a conical surface close to a cylindrical surface centered on the axis Ax. The total reflection surface 24Bb2 is configured as a curved surface having a rotational curved surface having a convex curved surface shape centered on the axis Ax as a reference surface.

Then, the total reflection controller 24B is configured to reflect the light from the light emission center of the light emitting element 22 incident from the incident surface 24Bb1 as parallel light toward slightly downward on the total reflection surface 24Bb2.

The total reflection surface 24Bb2 of the total reflection controller 24B is divided into eight reflection regions L1, L2, L3, L4, R1, R2, R3, and R4 in the circumferential direction around the axis Ax. Specifically, these eight reflection regions L1 to L4 and R1 to R4 have a fan-shaped outer shape having the same size centered on the axis Ax in the front view of the lamp, and are disposed symmetrically on both of the left and right sides of the vertical plane including the axis Ax.

In these eight reflection regions L1 to L4 and R1 to R4, a light reflection angle in the vertical direction is set to a slightly different value for each reflection region, but the reflection regions in the symmetrical positional relationship (i.e., each of the reflection regions L1 to L4 and each of the reflection regions R1 to R4) have a symmetrical surface shape.

An emission surface 24*a* of the light transmitting member 24 is constituted by three emission regions 24*a*A, 24*a*B, and 24*a*C that are concentrically divided in the front view of the lamp.

The emission region 24*a*A positioned at the center is a circular region centered on the axis Ax in the front view of the lamp, and has a diameter set to a value slightly larger than a diameter of the inner peripheral edge of the total reflection surface 24Bb2 of the total reflection controller 24B.

The emission region 24*a*B adjacent to the outer peripheral side of the emission region 24*a*A is formed as an annular region displaced forward of the lamp with respect to the emission region 24*a*A. Further, the emission region 24*a*C adjacent to the outer peripheral side of the emission region 24*a*B is formed as an annular region displaced forward of the lamp with respect to the emission region 24*a*B.

In each of the emission regions 24*a*A to 24*a*C, a plurality of horizontal diffusion lens elements 24*s*A, 24*s*B, and 24*s*C that diffuses the light from the light emitting element 22 that has reached to the emission regions 24*a*A to 24*a*C in the horizontal direction is formed. Each of the horizontal diffusion lens elements 24*s*A to 24*s*C is formed in a convex cylindrical lens shape extending in the vertical direction, and is configured to diffuse the light from the light emitting element 22 evenly to the left and right in the horizontal direction.

At this time, a diffusion angle of the horizontal diffusion lens element 24*s*A formed in the emission regions 24*a*A is set to a value larger than that of a diffusion angle of the horizontal diffusion lens element 24*s*B formed in the emission region 24*a*B. Further, the diffusion angle of the horizontal diffusion lens element 24*s*B formed in the emission regions 24*a*B is set to a value larger than that of a diffusion angle of the horizontal diffusion lens element 24*s*C formed in the emission region 24*a*C.

Next, a configuration of the second lamp unit 40 will be described.

As illustrated in FIG. 4, the second lamp unit 40 is also configured to irradiate light emitted from a light emitting element 42 toward the front of the lamp through a light transmitting member 44.

However, as illustrated in FIG. 1, the second lamp unit 40 has a configuration in which the first lamp unit 20 is rotated in a predetermined angle (specifically, 15°) clockwise (anti-clockwise in the front view of the lamp) around the axis Ax extending in the front-rear direction of the lamp, and an emission surface 44*a* of the light transmitting member 44 is partially different from the case of the first lamp unit 20

That is, the light emitting element 42 of the second lamp unit 40 has the same configuration as the light emitting element 22 of the first lamp unit 20, and is disposed toward the front of the lamp in a state of being mounted on a substrate 46 above near the axis Ax, but the lower end edge of a light emitting surface 42*a* extends in an oblique direction inclined by 15° with respect to the horizontal direction.

Further, the light transmitting member 44 of the second lamp unit 40 is configured to include a direct light controller 44A that directly emits light incident from the light emitting element 42 onto the light transmitting member 44 toward the front of the lamp, and a total reflection controller 44B that totally reflects the light incident from the light emitting element 42 onto the light transmitting member 44, and then emits the light toward the front of the lamp.

A rear surface 44Ab of the direct light controller 44A and a rear surface 44Bb of the total reflection controller 44B have the same shape as the case of the first lamp unit 20, but are configured to be rotated by 15° clockwise.

Similarly to the case of the first lamp unit 20, the emission surface 44*a* of the light transmitting member 44 is constituted by three emission regions 44*a*A, 44*a*B, and 44*a*C that are concentrically divided in the front view of the lamp. In each of the emission regions 44*a*A to 44*a*C, a plurality of oblique diffusion lens elements 44*s*A, 44*s*B, and 44*s*C that diffuses the light emitted from the light transmitting member 44 in an oblique direction inclined by 15° with respect to the horizontal direction is formed.

Each of the oblique diffusion lens elements 44*s*A to 44*s*C is formed in a convex cylindrical lens shape extending in the direction orthogonal to the oblique direction, and is configured to diffuse the light from the light emitting element 42 evenly to the left and right in the oblique direction.

However, a diffusion angle of each of the oblique diffusion lens elements 44*s*A to 44*s*C is set to a value smaller (e.g., a value of about half) than that of the diffusion angle of each of the horizontal diffusion lens elements 24*s*A to 24*s*C in the lamp unit 20.

At this time, the diffusion angle of the oblique diffusion lens element 44*s*A is set to a value larger than that of the diffusion angle of the oblique diffusion lens element 44*s*B, and further, the diffusion angle of the oblique diffusion lens element 44*s*B is set to a value larger than that of the diffusion angle of the oblique diffusion lens element 44*s*C.

Next, a configuration of the third lamp unit 60 will be described.

As illustrated in FIG. 1, the third lamp unit 60 is also configured to irradiate light emitted from a light emitting element 62 toward the front of the lamp through a light transmitting member 64.

However, in the third lamp unit 60, the arrangement of the light emitting element 62 and the configuration of the light transmitting member 64 are partially different from the case of the first lamp unit 20.

That is, the light emitting element 62 of the third lamp unit 60 has the same configuration as the case of the first lamp unit 20, but is disposed in a state where the center of a light emitting surface 62*a* is positioned on the axis Ax extending in the front-rear direction of the lamp.

Further, the light transmitting member 64 of the third lamp unit 60 is configured to include a direct light controller 64A that directly emits light incident from the light emitting element 62 onto the light transmitting member 64 toward the front of the lamp, and a total reflection controller 64B that totally reflects the light incident from the light emitting element 62 on the light transmitting member 64, and then emits the light toward the front of the lamp.

A configuration of a rear surface 64Ab of the direct light controller 64A is the same as the case of the first lamp unit 20. Meanwhile, in a rear surface 64Bb of the total reflection controller 64B, a total reflection surface 64Bb2 is configured as a rotational curved surface having a convex curved surface shape centered on the axis Ax, and is not divided into eight reflection regions as the case of the first lamp unit 20.

Similarly to the case of the first lamp unit 20, the emission surface 64*a* of the light transmitting member 64 is constituted by three emission regions 64*a*A, 64*a*B, and 64*a*C that are concentrically divided in the front view of the lamp. In each of the emission regions 64*a*A to 64*a*C, a plurality of horizontal diffusion lens elements 64*s*A, 64*s*B, and 64*s*C that diffuses the light emitted from the light transmitting member 64 in the horizontal direction is formed.

Each of the horizontal diffusion lens elements 64*s*A to 64*s*C is formed in a convex cylindrical lens shape extending in the vertical direction, and is configured to diffuse the light from the light emitting element 62 evenly to the left and right in the horizontal direction.

A diffusion angle of each of the horizontal diffusion lens elements 64*s*A to 64*s*C is set to a value slightly smaller (e.g., a value of about 80%) than that of the diffusion angle of each of the horizontal diffusion lens elements 24*s*A to 24*s*C in the lamp unit 20.

At this time, the diffusion angle of the horizontal diffusion lens element 64*s*A is set to a value larger than that of the diffusion angle of the horizontal diffusion lens element 64*s*B, and further, the diffusion angle of the horizontal diffusion lens element 64*s*B is set to a value larger than that of the diffusion angle of the horizontal diffusion lens element 64*s*C.

FIGS. 6A and 6B are views transparently illustrating light distribution patterns formed on a virtual vertical screen disposed at a position 25 m ahead of the vehicle front, by light irradiated from the vehicle lamp 10 toward the front of the lamp. FIG. 6A is a view illustrating a low beam light distribution pattern PL1, and FIG. 6B is a view illustrating a high beam light distribution pattern PHE The low beam light distribution pattern PL1 illustrated in FIG. 6A is a low beam light distribution pattern of a left light distribution, and has horizontal and oblique cut-off lines CL1 and CL2 on the upper end edge thereof. In the cut-off lines CL1 and CL2, a facing lane side portion on the right side of line V-V vertically passing through H-V, which are the vanishing points in the front direction of the lamp, is formed as the horizontal cut-off line CL1, and a vehicle lane side portion on the left side of line V-V is formed as the oblique cut-off line CL2, and an elbow point E, which is the intersecting point of the cut-off lines, is positioned about 0.5° to 0.6° below H-V.

The low beam light distribution pattern PL1 is formed as a combined light distribution pattern of a light distribution pattern PA1 formed by irradiation light from the first lamp unit 20 and a light distribution pattern PB1 formed by irradiation light from the second lamp unit 40.

The light distribution pattern PA1 is a horizontally long light distribution pattern that is widened in the left-right direction around line V-V, and forms the horizontal cut-off line CL1 of the low beam light distribution pattern PL1 at the upper end edge.

FIG. 7A to FIG. 9B are views illustrating a forming process of the light distribution pattern PA1.

Figure 7A:
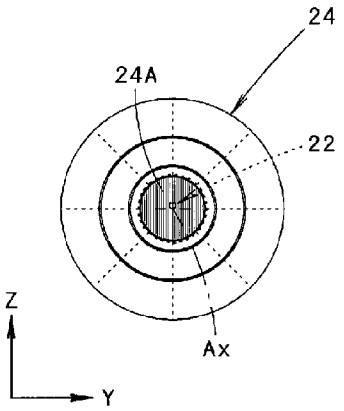
FIGS. 7A to 7C are views illustrating a forming process of a light distribution pattern formed by irradiation light from the first lamp unit (First).
Figure 7B:
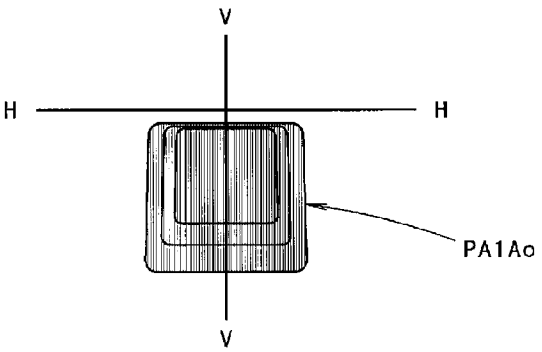
Figure 7C:
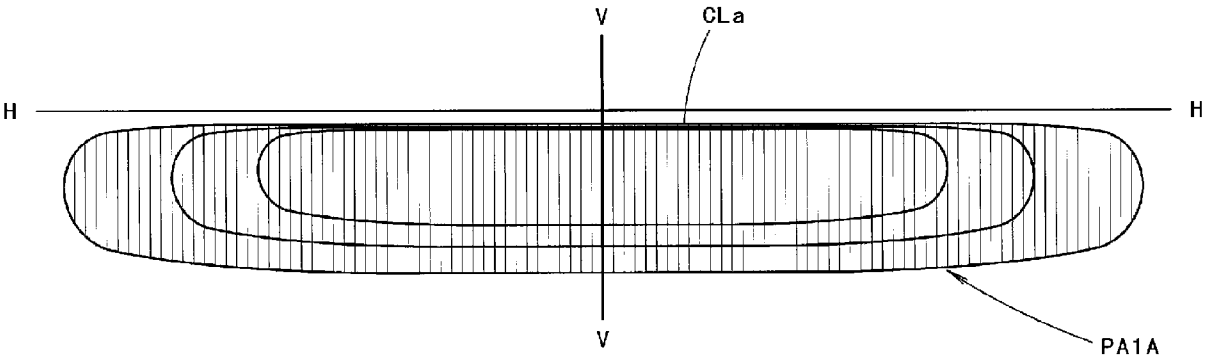

FIG. 7C is a view illustrating a light distribution pattern PA1A formed by light emitted from the direct light controller 64A in the light distribution pattern PA1.

The light distribution pattern PA1A is a horizontally long light distribution pattern formed by widening a light distribution pattern PA1Ao illustrated in FIG. 7B to both the left and right sides.

As illustrated in FIG. 7A, the light distribution pattern PA1Ao is a light distribution pattern formed by light emitted from the direct light controller 24A in a case of assuming that a plurality of horizontal diffusion lens elements 24*s*A to 24*s*C is not formed on the emission surface 24*a* of the light transmitting member 24.

The light distribution pattern PA1Ao is formed as a light distribution pattern having a substantially square outer shape below line H-H horizontally passing through H-V, and has a clear light-and-darkness boundary line extending in the horizontal direction at the upper end edge. It is because the lower end edge of the light emitting surface 22*a* of the light emitting element 22 extends in the horizontal direction above near the axis Ax, and the direct light controller 24A of the light transmitting member 24 is configured to direct light emitted from the light emission center of the light emitting element 22 on the rear surface 24Ab as parallel light slightly downward to be incident.

In practice, since the plurality of horizontal diffusion lens elements 24*s*A to 24*s*C are formed on the emission surface 24*a* of the light transmitting member 24, the light distribution pattern PA1A formed by the light emitted from the direct light controller 24A is formed as a horizontally long light distribution pattern as illustrated in FIG. 7C, and a clear light-darkness line CLa extending in the horizontal direction is formed at the upper end edge.

In each of the light distribution patterns PA1Ao and PA1A, the multiple curved lines formed therein indicate that the region surrounded by the curved lines is relatively bright. This is also applied to other light distribution patterns.

Figure 8:
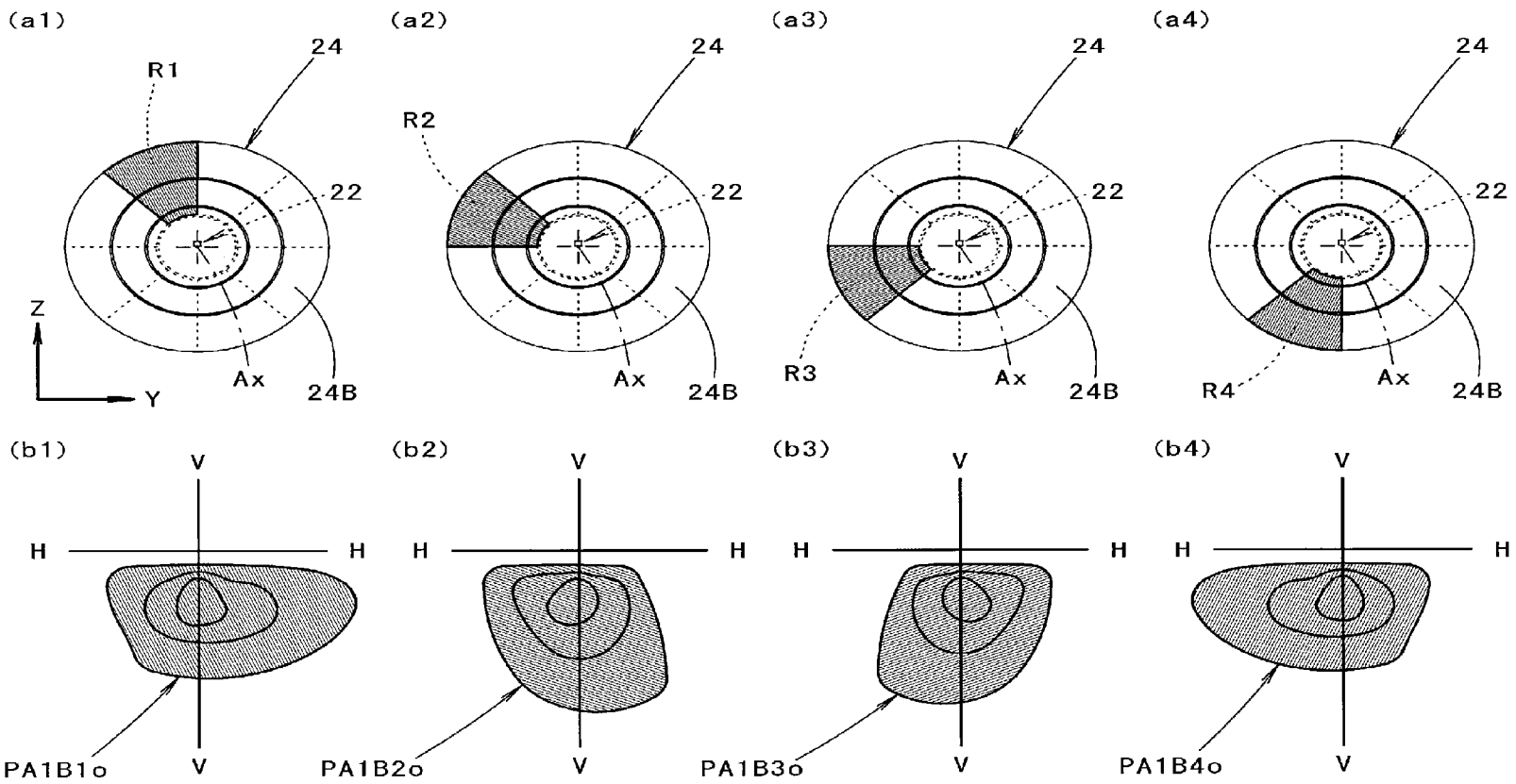
FIG. 8 is a view illustrating a forming process of a light distribution pattern formed by irradiation light from the first lamp unit (Second).

FIG. 8 illustrates light distribution patterns formed by light emitted from the right half region of the total reflection controller 24B in a case of assuming that the plurality of horizontal diffusion lens elements 24*s*A to 24*s*C are not formed on the emission surface 24*a* of the light transmitting member 24.

A light distribution pattern PA1B1*o* illustrated in (b1) of FIG. 8 is a light distribution pattern formed by reflected light from the reflection region R1 illustrated in (a1) of FIG. 8. The light distribution pattern PA1B1*o* is formed as a horizontally slightly long light distribution pattern straddling line V-V. In the light distribution pattern PA1B1*o*, the upper region is relatively bright, and a light-darkness boundary line extending in a substantially horizontal direction is formed at the upper end edge.

A light distribution pattern PA1B2*o* illustrated in (b2) of FIG. 8 is a light distribution pattern formed by reflected light from the reflection region R2 illustrated in (a2) of FIG. 8. The light distribution pattern PA1B2*o* is formed as a horizontally slightly long light distribution pattern straddling line V-V. In the light distribution pattern PA1B2*o*, the upper region is relatively bright, and a light-darkness boundary line extending in a substantially horizontal direction is formed at the upper end edge.

A light distribution pattern PA1B3*o* illustrated in (b3) of FIG. 8 is a light distribution pattern formed by reflected light from the reflection region R3 illustrated in (a3) of FIG. 8. The light distribution pattern PA1B3*o* is formed as a horizontally slightly long light distribution pattern straddling line V-V. In the light distribution pattern PA1B3*o*, the upper region is relatively bright, and a light-darkness boundary line extending in a substantially horizontal direction is formed at the upper end edge.

A light distribution pattern PA1B4*o* illustrated in (b4) of FIG. 8 is a light distribution pattern formed by reflected light from the reflection region R4 illustrated in (a4) of FIG. 8. The light distribution pattern PA1B4*o* is formed as a horizontally slightly long light distribution pattern straddling line V-V. In the light distribution pattern PA1B4*o*, the upper region is relatively bright, and a light-darkness boundary line extending in a substantially horizontal direction is formed at the upper end edge.

The surface shape of each of the reflection regions R1 to R4 is set such that the upper end edge of each of the light distribution patterns PA1B1*o* to PA1B4*o* is at substantially the same height position as the upper end edge of the light distribution pattern PA1A illustrated in FIG. 7C.

Figure 9A:
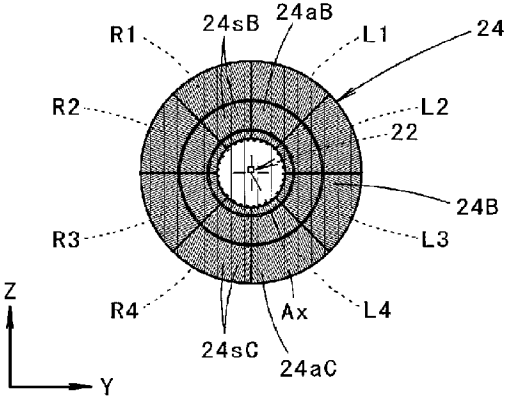
FIGS. 9A and 9B are views illustrating a forming process of a light distribution pattern formed by irradiation light from the first lamp unit (Third).
Figure 9B:
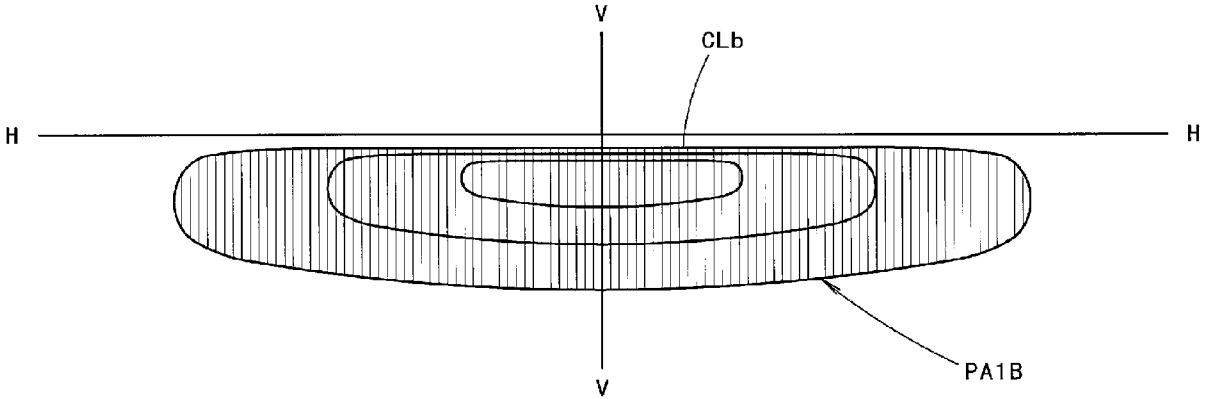

In practice, as illustrated in FIG. 9A, since the plurality of horizontal diffusion lens elements 24*s*A to 24*s*C are formed on the emission surface 24*a* of the light transmitting member 24, as illustrated in FIG. 9B, the light distribution pattern PB1 formed by light emitted from the entire total reflection controller 24B is formed as a horizontally long light distribution pattern obtained by widening the four light distribution patterns PA1B1*o* to PA1B4*o* illustrated in (b1) to (b4) of FIG. 8 and four light distribution pattern having a shape in which the four light distribution patterns are inverted in the left-right direction to both the left and right sides. As a result, a relatively clear light-darkness boundary line CLb is formed on the upper end edge.

Then, the horizontal cut-off line CL1 of the low beam light distribution pattern PL1 is formed by the light-darkness boundary line CLa of the light distribution pattern PA1A and the light-darkness boundary line CLb of the light distribution pattern PA1B.

The light distribution pattern PB1 illustrated in FIG. 6A is a horizontally long light distribution pattern that is widened in the oblique direction inclined by 15° clockwise with respect to the horizontal direction, and forms the oblique cut-off line CL2 of the low beam light distribution pattern PL1 at the upper end edge.

FIG. 10 is a view illustrating a forming process of the light distribution pattern PB1 illustrated in FIG. 6A.

The light distribution pattern PB1 is formed as a combined light distribution pattern of a light distribution pattern PB1A illustrated in (b1) of FIG. 10 and a light distribution pattern PB1B illustrated in (b2) of FIG. 10.

The light distribution pattern PB1A is a light distribution pattern formed by light emitted from the direct light controller 44A of the light transmitting member 44 illustrated in (a1) of FIG. 10, and as illustrated in (b1) of FIG. 10, is formed as a horizontally long light distribution pattern that is widened in the oblique direction, and forms a clear light-darkness boundary lien CLc extending in the oblique direction at the upper end edge.

The light distribution pattern PB1B is a light distribution pattern formed by light emitted from the total reflection controller 44B of the light transmitting member 44 illustrated in (a2) of FIG. 10, and as illustrated in (b2) of FIG. 10, is formed as a horizontally long light distribution pattern that is widened in the oblique direction, and forms a light-darkness boundary lien CLd extending in the oblique direction at the upper end edge.

Then, the oblique cut-off line CL2 of the low beam light distribution pattern PL1 is formed by the light-darkness boundary lines CLc and CLd.

As illustrated in FIG. 6A, in the low beam light distribution pattern PL1, a portion positioned at the lower left of the elbow point E where the high-intensity light region of the light distribution pattern PA1 and the high-intensity light region of the light distribution pattern PB1 are overlapped with each other constitutes a high-intensity light region.

The high beam light distribution pattern PH1 illustrated in FIG. 6B is formed by adding a light distribution pattern PC1 to the low beam light distribution pattern PL1.

The light distribution pattern PC1 is a light distribution pattern formed by irradiation light from the third lamp unit 60, and is formed as a horizontally long light distribution pattern that is widened in the left-right direction around line V-V.

The light distribution pattern PC1 is a light distribution pattern having a left-right diffusion angle slightly smaller than that of the light distribution pattern PA1, and is evenly widened to both the upper and lower sides of line H-H so as to partially overlap with the light distribution patterns PA1 and PB1.

Then, a distant visibility of the vehicle front travel path is sufficiently secured by forming such high beam light distribution pattern PHE Next, the operational effects of the present embodiment will be described.

The vehicle lamp 10 according to the embodiment includes the first and second lamp units 20 and 40, and the light transmitting members 24 and 44 of each of the first and second lamp units 20 and 40 include the direct light controllers 24A and 44A that directly emit light incident from the light emitting elements 22 and 42 onto the light transmitting members 24 and 44 toward the front of the lamp, and the total reflection controllers 24B and 44B that totally reflect the light incident from the light emitting elements 22 and 42 onto the light transmitting members 24 and 44, and then emit the light toward the front of the lamp. Therefore, it is possible to emit most of the light emitted from the light emitting elements 22 and 42 from the light transmitting members 24 and 44 toward the front of the lamp, and thus, it is possible to improve the utilization efficiency of the light source light flux.

At this time, in the first lamp unit 20, the total reflection surface 24Bb2 of the total reflection controller 24B of the transmitting member 24 is divided into the eight reflection regions L1, L2, L3, L4, R1, R2, R3, and R4 in the circumferential direction around the direct light controller 24A, and thus, it is possible to easily align the upper end positions of, for example, the light distribution patterns PA1B1*o*, PA1B2*o*, PA1B3*o*, and PA1B4*o* formed by the reflected light from each of the reflection regions L1 to L4 and R1 to R4.

In the same manner, in the second lamp unit 40, a total reflection surface 44Bb2 of the total reflection controller 44B of the light transmitting member 44 has the same configuration as that of the light transmitting member 24 of the first lamp unit 20, and thus, it is possible to easily align the upper end positions of the light distribution pattern formed by the reflected light from each of the reflection regions.

The plurality of horizontal diffusion lens elements 24*s*A, 24*s*B, and 24*s*C that diffuse the light emitted from the light transmitting member 24 in the horizontal direction are formed on the emission surface 24*a* of the light transmitting member 24 of the first lamp unit 20, and the plurality of oblique diffusion lens elements 44*s*A, 44*s*B, and 44*s*C that diffuse the light emitted from the light transmitting member 44 in the oblique direction inclined with respect to the horizontal direction are formed on the emission surface 44*a* of the light transmitting member 44 of the second lamp unit 40. Therefore, it is possible to form the bright low beam light distribution pattern PL1 having the horizontal and oblique cut-off lines CL1 and CL2 at the upper end edge by the irradiation light from the first and second lamp units 20 and 40.

As described above, according to the embodiment, in the vehicle lamp 10 including the lamp unit configured to irradiate light emitted from the light emitting element toward the front of the lamp through the light transmitting member, it is possible to form the bright light distribution pattern PL1 having the horizontal and oblique cut-off lines CL1 and CL2 at the upper end edge after improving the utilization efficiency of the light source light flux.

At this time, in the embodiment, the light emitting element 22 of the first lamp unit 20 is disposed such that the lower end edge of the light emitting surface 22*a* thereof extends in the horizontal direction, and further, the light emitting element 42 of the second lamp unit 40 is disposed such that the lower end edge of the light emitting surface 42*a* thereof extends in the oblique direction. Therefore, the clear light-darkness boundary line CLa extending in the horizontal direction may be formed at the upper end edge of the light distribution pattern PA1A formed by the light emitted from the direct light controller 24A of the first lamp unit 20, and the clear light-darkness boundary line CLc extending in the oblique direction may be formed at the upper end edge of the light distribution pattern PB1A formed by the light emitted from the direct light controller 44A of the second lamp unit 40. Therefore, the horizontal and oblique cut-off lines CL1 and CL2 of the low beam light distribution pattern PL1 may become clear.

Further, in the embodiment, in the light transmitting member 24 of the first lamp unit 20, the diffusion angle of the horizontal diffusion lens element 24*s*A formed on the emission region 24*a*A, which is the emission surface of the direct light controller 24A, is set to a value larger than those of the diffusion angles of the horizontal diffusion lens elements 24*s*B and 24*s*C formed on the emission regions 24*a*B and 24*a*C, which are the emission surfaces of the total reflection controller 24*b*, and further, in the light transmitting member 44 of the second lamp unit 40, the diffusion angle of the oblique diffusion lens element 44*s*A formed on the emission region 44*a*A, which is the emission surface of the direct light controller 44A, is set to a value larger than those of the diffusion angles of the oblique diffusion lens elements 44*s*B and 44*s*C formed on the emission regions 44*a*B and 44*a*C, which are the emission surfaces of the total reflection controller 44B. As a result, following operation effects may be obtained.

That is, since the direct light controllers 24A and 44A are positioned closer to the light emitting elements 22 and 42 than the total reflection controllers 24B and 44B, for example, the light distribution pattern PA1Ao formed by the light emitted from the direct light controllers 24A and 44A becomes a light distribution pattern larger than, for example, the light distribution patterns PA1B1*o* to PA1B4*o* formed by the light emitted from the total reflection controllers 24B and 44B.

Therefore, the diffusion angles of the horizontal diffusion lens element 24*s*A and the oblique diffusion lens element 44*s*A formed on the emission regions 24*s*A and 44*a*A that constitute the emission surfaces of the direct light controllers 24A and 44A are set to values larger than those of the diffusion angles of the horizontal diffusion lens elements 24*s*B and 24*s*C and the oblique diffusion lens elements 44*s*B and 44*s*C formed on the emission regions 24*a*B and 24*a*C, and 44*a*B and 44*a*C that constitute the emission surfaces of the total reflection controllers 24B and 44B, so that the light distribution patterns PA1 and PB1 formed by the irradiation light from the first and second lamp units 20 and 40 may be formed as light distribution patterns with less light distribution unevenness.

Further, in the embodiment, in the light transmitting member 24 of the first lamp unit 20, the emission surface of the total reflection controller 24B is divided into the emission region 24*a*B (inner peripheral side annular region) and the emission region 24*a*C (outer peripheral side annular region), and the diffusion angle of the horizontal diffusion lens element 24*s*B formed on the emission region 24*a*B is set to a value larger than that of the diffusion angle of the horizontal diffusion lens element 24*s*C formed on the emission region 24*a*C. Further, in the light transmitting member 44 of the second lamp unit 40, the emission surface of the total reflection controller 44B is divided into the emission region 44*a*B (inner peripheral side annular region) and the emission region 44*a*C (outer peripheral side annular region), and the diffusion angle of the oblique diffusion lens element 44*s*B formed on the emission region 44*a*B is set to a value larger than that of the diffusion angle of the oblique diffusion lens element 44*s*C formed on the emission region 44*a*C. As a result, following operation effects may be obtained.

That is, the light distribution patterns formed by the light emitted from the emission regions 24*a*B and 44*a*B become a light distribution pattern larger than the light distribution patterns formed by the light emitted from the emission regions 24*a*C and 44*a*C. Therefore, the diffusion angles of the horizontal and oblique diffusion lens elements 24*s*B and 44*s*B formed on the emission regions 24*a*B and 44*a*B are set to values larger than those of the diffusion angles of the horizontal and oblique diffusion lens elements 24*s*C and 44*s*C formed on the emission regions 24*a*C and 44*a*C, so that the light distribution patterns PA1 and PB1 formed by the irradiation light from the first and second lamp units 20 and 40 may be formed as light distribution patterns with less light distribution unevenness.

At this time, in each of the light transmitting members 24 and 44 of the first and second lamp units 20 and 40, the emission regions 24*a*B and 44*a*B that constitute the emission surface of the total reflection controllers 24B and 44B are displaced forward of the lamp with respect to the emission regions 24*a*A and 44*a*A that constitute the emission surface of the direct light controller 24A and 44A, and further, the emission regions 24*a*C and 44*a*C that constitute the emission surface of the total reflection controller 24C and 44C are displaced forward of the lamp with respect to the emission regions 24*a*B and 44*a*B that constitute the emission surface of the total reflection controller 24B and 44B. As a result, the thickness of the light transmitting members 24 and 44 may be reduced.

Further, the vehicle lamp 10 according to the embodiment is configured to form the high beam light distribution pattern PH1 by adding the irradiation light from the third lamp unit 60 having substantially the same configuration as the first and second lamp units 20 and 40, and thus, it is possible to exert the function as a headlamp after securing the uniformity in design.

In the above embodiment, the total reflection surface 24Bb of the total reflection controller 24B of the light transmitting member 24 has been described as being divided into the eight reflection regions L1 to L4 and R1 to R4, but it is also possible to have a configuration divided into nine or more or seven or less reflection regions.

In the above embodiment, each of the horizontal diffusion lens elements 24*s*A to 24*s*C, 44*s*A to 44*s*C, and 64*s*A to 64*s*C has been described as being formed in a convex cylindrical lens shape, but it is also possible to form the horizontal diffusion lens elements in a concave cylindrical lens shape.

In the above embodiment, the total reflection surfaces 24Bb, 44Bb, and 64Bb of the total reflection controllers 24B, 44B, and 64B of the respective light transmitting members 24, 44, and 64 have been described as being configured as a rotational curved surface or a curved surface having the rotational curved surface as a reference surface, but it is also possible to have a configuration configured as other curved surfaces or a plurality of planes.

In the above embodiment, the emission surfaces 24*a*, 44*a*, 64*a* of the respective light transmitting members 24, 44, and 64 have been described as being concentrically divided in the front view of the lamp, but it is also possible to have a configuration divided into other shapes (e.g., elliptical shape or rectangular shape).

Next, modifications of the above embodiment will be described.

First, Modification 1 of the above embodiment will be described.

FIG. 11 is a view illustrating a second lamp unit 140 according to Modification 1, which is similar to FIG. 4.

As illustrated in FIG. 11, the second vehicle lamp 140 according to Modification 1 is also identical in its basic configuration to that of the above embodiment. However, the configuration of the light transmitting member 144 is partially different from that of the above embodiment.

That is, the light transmitting member 144 according to Modification 1 is also configured to include a direct light controller 144A that directly emits light incident from the light emitting element 42 onto the light transmitting member 144 toward the front of the lamp, and a total reflection controller 144B that totally reflects the light incident from the light emitting element 42 onto the light transmitting member 144, and then emits the light toward the front of the lamp.

The configurations of a rear surface 144Ab of the direct light controller 144A and a rear surface 144Bb of the total reflection controller 144B are the same as those of the above embodiment. However, the configuration of an emission surface 144*a* of the light transmitting member 144 is partially different from that of the above embodiment.

Specifically, also in the light transmitting member 144 according to Modification 1, although a plurality of oblique diffusion lens elements 144*s*A, 144*s*B, and 144*s*C having a convex cylindrical lens shape is formed in emission regions 144*a*A, 144*a*B, and 144*a*C that constitute the emission surface 144*a*, each of the oblique diffusion lens elements 144*s*A to 144*s*C is formed so as to largely diffuse the light emitted from the oblique diffusion lens elements 144*s*A to 144*s*C more to the left direction than the right direction (left direction in FIG. 11) with respect to the front direction of the lamp.

At this time, a diffusion angle of the oblique diffusion lens element 144*s*A is set to a value larger than that of a diffusion angle of the oblique diffusion lens element 144*s*B, and further, the diffusion angle of the oblique diffusion lens element 144*s*B is set to a value larger than that of a diffusion angle of the oblique diffusion lens element 144*s*C.

FIGS. 12A and 12B are views illustrating a light distribution pattern formed by light irradiated from the vehicle lamp according to Modification 1 toward the front of the lamp, which are similar to FIGS. 6A and 6B.

A low beam light distribution pattern PL2 illustrated in FIG. 12A is formed as a combined light distribution pattern of the same light distribution pattern PA1 as in the above embodiment and a light distribution pattern PB2 formed by irradiation light from the second lamp unit 140.

The light distribution pattern PB2 has the same shape as the light distribution pattern PB1 in the above embodiment, but is formed at a position displaced in the upper left direction along the oblique cut-off line CL2 from the light distribution pattern PB1.

This is because, in the light transmitting member 144 according to Modification 1, each of the oblique diffusion lens elements 144*s*A to 144*s*C formed in the emission regions 144*a*A to 144*a*C that constitute the emission surface 144*a* is configured so as to largely diffuse the light emitted from the diffusion lens elements 144*s*A to 144*s*C more to the left direction than the right direction with respect to the front direction of the lamp.

A high beam light distribution pattern PH2 illustrated in FIG. 12B is formed by adding the same light distribution pattern PC1 as in the above embodiment to the low beam light distribution pattern PL2.

By adopting the configuration of Modification 1, the following operational effects may be obtained.

That is, also in the low beam light distribution pattern PL2 formed by irradiation light from the vehicle lamp according to Modification 1, a portion positioned at the lower left of the elbow point E where the high-intensity light region of the light distribution pattern PA1 and the high-intensity light region of the light distribution pattern PB2 are overlapped with each other constitutes a high-intensity light region. However, the position of the high-intensity light region is displaced to the upper left direction as compared with the low beam light distribution pattern PL1 formed in the above embodiment, and thus, the distant visibility of the road shoulder portion of the vehicle lane side may be further enhanced.

Next, Modification 2 of the above embodiment will be described.

FIG. 13 is a view illustrating a first lamp unit 220 according to Modification 2, which is similar to FIG. 3.

As illustrated in FIG. 13, the first vehicle lamp 220 according to Modification 2 is also identical in its basic configuration to that of the above embodiment. However, the configuration of the light transmitting member 224 is partially different from that of the above embodiment.

That is, the light transmitting member 224 of the first lamp unit 220 according to Modification 2 is also configured to include a direct light controller 224A that directly emits light incident from the light emitting element 22 onto the light transmitting member 224 toward the front of the lamp, and a total reflection controller 224B that totally reflects the light incident from the light emitting element 22 onto the light transmitting member 224, and then emits the light toward the front of the lamp.

The configurations of a rear surface 224Ab of the direct light controller 224A and a rear surface 224Bb of the total reflection controller 224B are the same as those of the above embodiment. However, the configuration of an emission surface 224*a* of the light transmitting member 224 is partially different from that of the above embodiment.

Specifically, also in the light transmitting member 224 according to Modification 2, a plurality of horizontal diffusion lens elements 224*s*A, 224*s*B, and 224*s*C having a convex cylindrical lens shape is formed in emission regions 224*a*A, 224*a*B, and 224*a*C that constitute the emission surface 224*a*.

At this time, the configuration of each horizontal diffusion lens element 224*s*C formed in the emission region 224*a*C is the same as in the above embodiment, but each of the horizontal diffusion lens elements 224*s*A and 224*s*B formed in the emission regions 224*a*A and 224*a*B is formed so as to largely diffuse light emitted from the horizontal diffusion lens elements 224*s*A and 224*s*B more to the direction close to the vertical plane than the direction away from the vertical plane including the axis Ax.

In Modification 2, a diffusion angle of the horizontal diffusion lens element 224*s*A is set to a value larger than that of a diffusion angle of the horizontal diffusion lens element 224*s*B, and further, the diffusion angle of the horizontal diffusion lens element 224*s*B is set to a value larger than that of a diffusion angle of the horizontal diffusion lens element 224*s*C.

In Modification 2, a second lamp unit (not illustrated) also has the same configuration as the first lamp unit 220 with respect to the above aspects.

As in Modification 2, the horizontal diffusion lens elements 224*s*A and 224*s*B is configured such that, in the front view of the lamp, the diffusion angle in the direction approaching the light emitting element 22 is set to a value larger than that of the diffusion angle in the direction away from the light emitting element. As a result, following operation effects may be obtained.

That is, the light emitted from the emission region 224*a*A that constitutes the emission surface of the direct light controller 224A may be hardly blocked by a standing wall positioned on the outer peripheral side of the emission region 224*a*A, and the light emitted from the emission region 224*a*B that constitutes the inner peripheral side annular region of the emission surface of the total reflection controller 224B may be hardly blocked by a standing wall positioned on the outer peripheral side of the emission region 224*a*B. Therefore, it is possible to improve the utilization efficiency of the light source light flux and to effectively suppress the generation of stray light.

The numerical values shown as specifications in the above embodiment and the modifications thereof are merely examples, and, of course, the numerical values may be appropriately set to different values.

Further, the present disclosure is not limited to the configurations described in the above embodiment and the modifications thereof, and configurations to which various other changes are added may be adopted.

This international application claims priority based on Japanese Patent Application No. 2019-069812, filed on Apr. 1, 2019, and the disclosure of Japanese Patent Application No. 2019-069812 is incorporated in this international application in its entire contents.

The above descriptions on the specific embodiments of the present disclosure are presented for purposes of illustration. The descriptions are not intended to be exhaustive or to limit the present disclosure to the precise form as described. It will be apparent to those skilled in the art that various modifications and variations are possible in light of the above descriptions.

DESCRIPTION OF SYMBOLS

10: vehicle lamp
12: lamp body
14: light transmitting cover
20, 220: first lamp unit
22, 42, 62: light emitting element
22*a*, 42*a*, 62*a*: light emitting surface
24, 44, 64, 144, 224: light transmitting member
24A, 44A, 64A, 144A, 224A: direct light controller
24Ab, 24Bb, 44Ab, 44Bb, 64Bb, 144Ab, 144Bb, 224Ab, 224Bb: rear surface
24*a*, 44*a*, 144*a*, 224*a*: emission surface
24*a*A, 44*a*A, 64*a*A, 144*a*A, 224*a*: emission region
24*a*B, 44*a*B, 64*a*B, 144*a*B, 224*a*B: emission region (inner peripheral side annular region)
24*a*C, 44*a*C, 64*a*C, 144*a*C, 224*a*C: emission region (outer peripheral side annular region)
24*s*A, 24*s*B, 24*s*C, 64*s*A, 64*s*B, 64*s*C, 224*s*A, 224*s*B, 224*s*C: horizontal diffusion lens element
24B, 44B, 64B, 144B, 224B: total reflection controller
24Bb1: incident surface
24Bb2, 64Bb2: total reflection surface
26, 46: substrate
40, 140: second lamp unit
44*s*A, 44*s*B, 44*s*C, 144*s*A, 144*s*B, 144*s*C: oblique diffusion lens element
60: third lamp unit
Ax: axis
CLa, CLb, CLc, CLd: light-darkness boundary line
CL1: horizontal cut-off line
CL2: oblique cut-off line
E: elbow point
L1, L2, L3, L4, R1, R2, R3, R4: reflection region
PA1, PA1A, PA1Ao, PA1B1*o*, PA1B2*o*, PA1B3*o*, PA1B4*o*, PB1, PB1A, PB1B, PB2, PC1: light distribution pattern
PH1, PH2: high beam light distribution pattern
PL1, PL2: low beam light distribution pattern

What is claimed is:

1. A vehicle lamp comprising:

a lamp unit including a first lamp unit and a second lamp unit each provided with a light transmitting member made of a transparent plate and configured to irradiate light emitted from a light emitting element including a light emitting diode toward a front of the vehicle lamp through the light transmitting member, wherein, in each of the first and second lamp units, the light transmitting member includes a direct light controller that directly emits light incident from the light emitting element onto the light transmitting member, toward the front of the vehicle lamp, and a total reflection controller that totally reflects the light and then emits the light toward the front of the vehicle lamp, a total reflection surface of the total reflection controller is divided into a plurality of reflection regions in a circumferential direction of the total reflection controller around the direct light controller, a plurality of horizontal diffusion lenses that diffuses the light emitted from the light transmitting member in a horizontal direction is continuously formed on an emission surface of the light transmitting member of the first lamp unit, and a plurality of oblique diffusion lenses that diffuses the light emitted from the light transmitting member in an oblique direction with respect to the horizontal direction is continuously formed on an emission surface of the light transmitting member of the second lamp unit.

2. The vehicle lamp according to claim 1, wherein the light emitting element of the first lamp unit is disposed such that a lower end edge of the light emitting surface of the light emitting element extends in the horizontal direction, and the light emitting element of the second lamp unit is disposed such that a lower end edge of the light emitting surface of the light emitting element extends in the oblique direction.

3. The vehicle lamp according to claim 1, wherein, in the light transmitting member of the first lamp unit, a diffusion angle of a horizontal diffusion lens formed on an emission surface of the direct light controller is set to be larger than a diffusion angle of a horizontal diffusion lens formed on an emission surface of the total reflection controller, and in the light transmitting member of the second lamp unit, a diffusion angle of the oblique diffusion lens formed on an emission surface of the direct light control unit is set to be larger than a diffusion angle of an oblique diffusion lens formed on an emission surface of the total reflection controller.

4. The vehicle lamp according to claim 1, wherein, in the light transmitting member of the first lamp unit, the emission surface of the total reflection controller is divided into an inner peripheral side annular region and an outer peripheral side annular region, and a diffusion angle of the horizontal diffusion lens formed on the inner peripheral side annular region is set to be larger than a diffusion angle of a horizontal diffusion lens formed on the outer peripheral side annular region, and in the light transmitting member of the second lamp unit, the emission surface of the total reflection controller is divided into an inner peripheral side annular region and an outer peripheral side annular region, and a diffusion angle of an oblique diffusion lens formed on the inner peripheral side annular region is set to be larger than a diffusion angle of an oblique diffusion lens formed on the outer peripheral side annular region.

5. The vehicle lamp according to claim 4, wherein, in the light transmitting member of each of the first and second lamp units, the emission surface of the total reflection controller is displaced in a forward side of the vehicle lamp with respect to the emission surface of the direct light controller, and the outer peripheral side annular region of the emission surface of the total reflection controller is displaced in the forward side of the vehicle lamp with respect to the inner peripheral side annular region of the emission surface.

6. The vehicle lamp according to claim 5, wherein, in the light transmitting member of the first lamp unit, the horizontal diffusion lens formed on the emission surface of the direct light controller and the horizontal diffusion lens formed on the inner peripheral side annular region of the emission surface of the total reflection controller are configured such that a diffusion angle in a direction approaching the light emitting element in a front view of the vehicle lamp is set to be larger than a diffusion angle in a direction away from the light emitting element, and in the light transmitting member of the second lamp unit, the oblique diffusion lens formed on the emission surface of the direct light controller and the oblique diffusion lens formed on the inner peripheral side annular region of the emission surface of the total reflection controller are configured such that a diffusion angle in a direction approaching the light emitting element in the front view of the vehicle lamp is set to be larger than a diffusion angle in a direction away from the light emitting element.

7. The vehicle lamp according to claim 1, wherein a diffusion angle of each of the plurality of oblique diffusion lenses of the second lamp unit is set to a value smaller than that of a diffusion angle of each of the plurality of horizontal diffusion lenses of the first lamp unit.

* * * * *